United States Patent [19]

Grigel et al.

[11] Patent Number: 4,592,512

[45] Date of Patent: Jun. 3, 1986

[54] METHOD AND APPARATUS FOR THE COMMON GRINDING OF TWO OR MORE BRITTLE MATERIALS HAVING DIFFERENT GRINDING PROPERTIES

[75] Inventors: Wolfgang Grigel, Lohmar; Hans Kellerwessel, Aachen; Raimund Zisselmar, Erftstadt, all of Fed. Rep. of Germany

[73] Assignee: Klöckner-Humboldt-Deutz AG, Fed. Rep. of Germany

[21] Appl. No.: 591,567

[22] Filed: Mar. 20, 1984

[30] Foreign Application Priority Data

Apr. 19, 1983 [DE] Fed. Rep. of Germany ..... 3314103

[51] Int. Cl.[4] ..... B02C 19/12

[52] U.S. Cl. ..... 241/24; 241/29

[58] Field of Search ..... 241/26, 30, 24, 152 A, 241/29, 101 D, 17, 8 D, 97, 69, 79.1

[56] References Cited

U.S. PATENT DOCUMENTS

| | | | |
|---|---|---|---|
| 2,090,363 | 8/1937 | Wendeborn | 241/101 D X |
| 2,721,806 | 10/1955 | Oberg et al. | 241/101 D X |

FOREIGN PATENT DOCUMENTS

| | | | |
|---|---|---|---|
| 1927164 | 9/1979 | Fed. Rep. of Germany | 241/231 |
| 565463 | 6/1957 | Italy | 241/230 |
| 791425 | 12/1980 | U.S.S.R. | 241/29 |

*Primary Examiner*—Mark Rosenbaum

*Attorney, Agent, or Firm*—Hill, Van Santen, Steadman & Simpson

[57] ABSTRACT

A roller crusher for receiving a harder to grind material, means mixing the harder to grind material with an easier to grind material and delivering the mixed materials to a ball mill for common grinding, separating the remaining coarse particles from material received by the grinder by a sieve or a cyclone, and recirculating the remaining the coarse particles to the ball mill.

5 Claims, 1 Drawing Figure

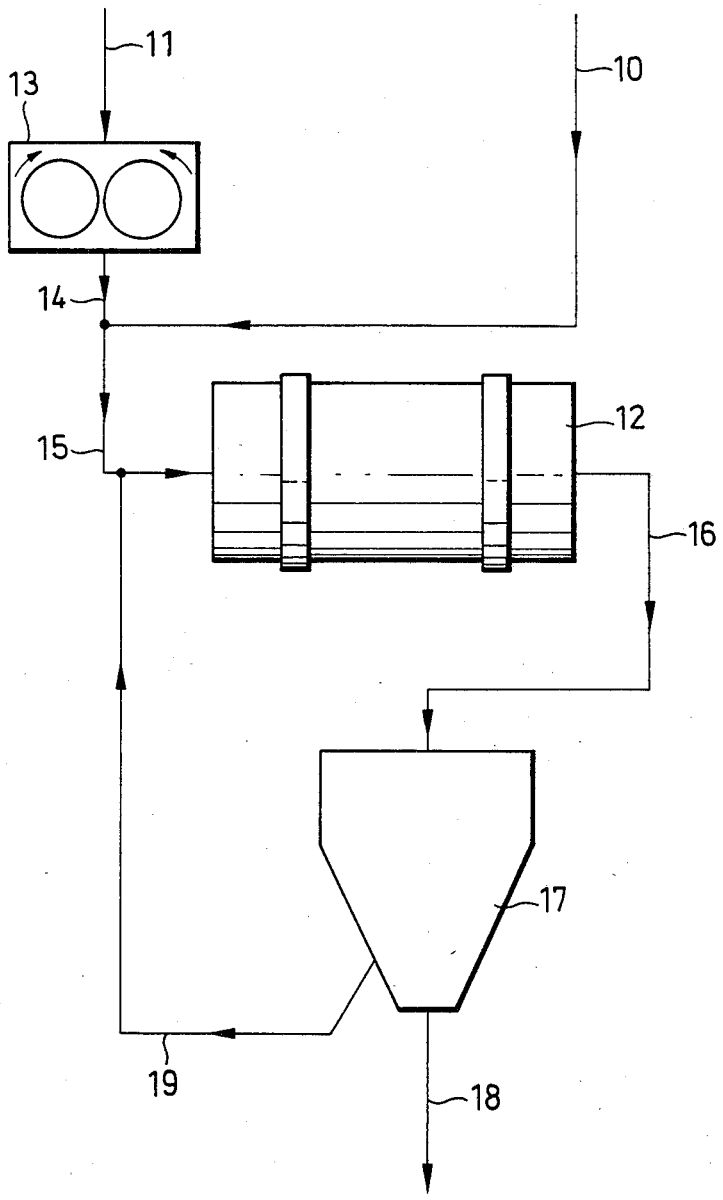
11
10
13
14
12
15
16
17
19
18

METHOD AND APPARATUS FOR THE COMMON GRINDING OF TWO OR MORE BRITTLE MATERIALS HAVING DIFFERENT GRINDING PROPERTIES

BACKGROUND OF THE INVENTION

The invention relates to an improved method and apparatus for the common grinding of two or more brittle materials having different grinding properties, such as portland cement, which is a more easily grindable material and blast furnace slag, which is a more difficult to grind material.

In the calcining of portland cement clinker from cement raw meal, the technically possible specific heat consumption as stabilized in recent years, is approximately 750 kcal/kg clinkers. For further energy savings, a greater opportunity is possible in the manufacture of mixed cements. That is, in the admixture of such materials to portland cement which do not need to be treated with the expenditure of heat. Such a material is granulated blast furnace slag for the manufacture of slag portland cement or blast furnace cement. With the use of this material, energy savings result from the substitution of from 10% to 75% of the cement clinker which is manufactured with a high energy expenditure with granulated blast furnace slag having latent hydraulic porperties. For exmaple, in current European community practice, cement utilizing approximately 70% portland cement and approximately 22% slag cement is produced. According to the German industrial standard (DIN), both components, namely portland cement clinker and granulated blast furnace slag must be commonly ground together. This is customarily done in a rotating cylindrical ball mill.

Common grinding of the slag with the portland cement clinker creates problems insofar as the two components have different grinding properties. The portland cement clinker is easier to grind, and the slag is more difficult to grind. Efforts have been made heretofore to attempt to grind the materials together, but this has not been successful, and one attempt has included separately grinding the products in different mills and thereafter mixing the ground products. In other manufacturing processes, the problem is presented of simultaneously grinding different products other than portland cement clinker and blast furnace slag wherein the materials have different grinding properties and must be ground together.

It is accordingly an object of the present invention to provide an improved method and apparatus which is capable of accomplishing the common grinding of materials having different grinding properties and wherein despite the fact of these different grinding properties, the resultant product has an equal or virtually equal granular size distribution.

A further object of the invention is to provide an improved method and apparatus for common grinding of materials having different grinding properties wherein the steps of grinding make possible the use of compact unitary apparatus and wherein the process and apparatus assures that the finished product is uniform and undesirable materials of incorrect particle size are not included in the finished product.

In accordance with a feature of the invention, there is involved a pretreatment of the material which is more difficult to grind, such as the slag, and this pretreatment includes improvement of the characteristics of the slag so that it is subsequently capable of being ground together with the material which is easier to grind, such as the portland cement clinker. After the pretreatment of the material, the harder to grind and the easier to grind substances are admixed and delivered to a common grinding apparatus. By the improvement of the grinding capability of the material which is more difficult to grind, virtually equal granular size distribution of all materials is attained so that uniform common grinding can be accomplished. This has as a consequence the fact that the solidification of the slag portland cement or blast furnace cement, which has heretofore been disadvantageously slow is eliminated, or substantially improved and matched to the solidification of the portland cement.

The pretreatment of the material which is more difficult to grind, prior to its common grinding with material which is more easy to grind, is accomplished by means of a pressure crushing of the first more difficult to grind material, preferably in the nip of rollers of a roller machine at a high pressure force. A roller grinder wherein the rollers are operated at a grinding pressure of more than 2 t/cm roller length is utilized. The roller grinder for the purposes of pressure crushing thus operates in accordance with the needs of the harder to grind material and operates at pressures in accordance with principles of individual granular crushing or product bed crushing or a combination of said individual granular crushing or product bed crushing. With the high pressure forces, product agglomerates can be formed from the precrushed materials of the substance which is more difficult to grind. The product agglomerates are then supplied and admixed with the substance which is easier to grind, and the two are supplied to a mill wherein the formed agglomerates are broken up and all substances are ground to uniform end fineness. The granular size of the significant portion of the material which is more difficult to grind can be greater or smaller than the width of the nip of the rollers.

In accordance with the present concepts, the pressure force of the roller grinder is so high that as great as possible a destruction of the particles of the material which is more difficult to grind is achieved. By product bed crushing referred to hereinabove, is meant that the more difficult to grind charging product is supplied to the nip of the rollers in such a large quantity that the product to be crushed is drawn between the rollers forces the rollers apart, and the particles of the charging product mutually crush one another in the nip of the rollers. Thus, in one charging a product bed pulverization is accomplished. A nip width between the rollers which are forced against one another in a resilient fashion thus develops which is greater than the particle size of the product fed therebetween.

Other objects, advantages and features will become more apparent with the teaching of the principles of the invention in connection with the disclosure of the preferred embodiment thereof in the specification, claims, and drawings, in which:

DESCRIPTION OF THE DRAWING

The single FIGURE of the drawing is a somewhat schematic illustration of a grinding apparatus constructed and operating in accordance with the principles of the present invention.

DESCRIPTION OF THE PREFERRED EMBODIMENT

The drawings illustrates apparatus for the common grinding of two brittle materials having different grinding properties. While certain features of the invention are particularly well adapted to the grinding of portland cement clinker which is easier to grind and granulated blast furnace slag which is more difficult to grind, it will be understood that features may be employed in the grinding of other dissimilar types of material.

The more easy to grind portland clinker is supplied from a supply shown at 10. The more difficult to grind granulated blast furnace slag is supplied from a means shown at 11.

The first more difficult to grind material is supplied to a roller grinder 13 having a pair of opposed rolls with a nip therebetween to which the material is fed. The two roller grinder 13 is operated in accordance with the principle of individual granular crushing and/or product bed crushing for the purpose of pretreating the material which is more difficult to grind. The pressure force of the rollers acting on the material is high and amounts to more than 2 t/cm roller length. The crushed and ground material, such as blast furnace slag, leaves the roller grinder at 14 where it is admixed with the material from the supply 10. The admixed material combines and is fed along a line 15 to a common grinding mill 12. The common grinding or cylindrical mill 12 is filled with grinding members such as steel balls and forms what is commonly known as a ball mill. As a consequence of the pregrinding of the blast furnace slag, the grinding product which is delivered out of the ball mill to a delivery line 16 is of equal or virtually equal granular size, that is, the material which was previously blast furnace slag and the material which was portland cement clinker are thoroughly mixed and equally ground.

The output of the cylindrical mill 12 which is delivered to the line 16 is then delivered to a separating device 17, such as by a bucket conveyor.

The separating device may include a sieve or similar means or a cyclone separator. In the separator 17 the ground product delivered from the line 16 is separated into a finished product 18 which is the uniformly ground material and a coarser fraction or granules which are unacceptable and which are returned via line 19 back to the entry of the ball mill to be admixed in the line 15 with the previously admixed blast furnace slag and portland cement clinker. The rejected material is thus reground in a continuous process.

If desirable, the removed granules in the line 19 may be admixed to the material in the line 10, or it may be fed back to be admixed to the material of the line 11 to again pass through the roller mill.

In operation, portland cement clinker is fed to the line 10 to be mixed with blast furnace slag which is supplied through the line 11. The blast furnace slag is fed through a roller mill 13, and the output 14 is mixed so that the combined product is fed through the line 15 into a ball mill 12. The output of the ball mill is fed through the line 16 to the separator 17 which delivers the finished product 18 and insufficiently ground particles are returned via the line 19 to the entry of the ball mill.

By the means of the pretreatment of the introduced slag 11, the reactivity of the slag and also that of the resulting mixed cement is increased. Also, the energy requirement for the manufacture of the mixed cement in totality is reduced. Also, by the features of the process and mechanism, the slag fed in through the line 11 which is otherwise largely present in the form of waste requiring treatment is expeditiously further utilized.

The invention also contemplates the new and improved process for making of cement comprising pregrinding or precrushing a quantity of blast furnace slag, mixing the preground slag with portland cement clinker and simultaneously grinding together the preground slag and portland cement clinker to provide a ground cement.

Thus, it will be seen that we have provided an improved method and mechanism which meets the objectives and advantages above set forth for the straight forward expeditious processing of materials for the production of cement.

We claim as our invention:

1. A method of making cement which comprises the steps:

pregrinding a quantity of granulated blast furnace slag by roller grinding the same in a roller grinder to which it is supplied in such large quantity that it is drawn between the rollers, forcing them apart and causing the particles to mutually crush one another, mixing the preground slag with a larger quantity of portland cement clinker, and grinding the mixture together in a ball mill to produce a mixed cement.

2. A method of grinding a plurality of types of brittle materials having different grinding properties in accordance with the steps of claim 1:

wherein the pressure force of the rolls in the roller grinder exceeds a pressure of 2 t/cm roller length.

3. A method of grinding a plurality of types of materials having different grinding properties according to claim 1 comprising the steps of:

separating the remaining coarse particles from the product of the ball mill;

recycling more coarse separated particles back into the ball mill;

and utilizing the finely ground product from the ball mill.

4. A method of grinding a plurality of brittle materials having different grinding properties in accordance with the steps of claim 3:

wherein separating after the ball mill is accomplished by a sieve.

5. A method of grinding a plurality of brittle materials having different grinding properties in accordance with the steps of claim 3:

wherein separating after the ball mill is accomplished by a cyclone separator.

* * * * *